US010350923B2

(12) United States Patent
Ando

(10) Patent No.: US 10,350,923 B2
(45) Date of Patent: Jul. 16, 2019

(54) THERMAL PRINTER AND PORTABLE TERMINAL

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 56 days.

(21) Appl. No.: 15/585,529

(22) Filed: May 3, 2017

(65) Prior Publication Data

US 2017/0326888 A1 Nov. 16, 2017

(30) Foreign Application Priority Data

May 16, 2016 (JP) ..... 2016-098105

(51) Int. Cl.

| | |
|---|---|
| ***B41J 29/02*** | (2006.01) |
| ***B41J 11/04*** | (2006.01) |
| ***B41J 2/32*** | (2006.01) |
| ***B41J 2/325*** | (2006.01) |
| ***B41J 29/38*** | (2006.01) |

(52) U.S. Cl.

CPC ..... *B41J 29/02* (2013.01); *B41J 2/32* (2013.01); *B41J 2/325* (2013.01); *B41J 11/04* (2013.01); *B41J 29/38* (2013.01)

(58) Field of Classification Search

CPC ..... B41J 29/02; B41J 11/04; B41J 2/32; B41J 2/325; B41J 29/38

See application file for complete search history.

(56) References Cited

U.S. PATENT DOCUMENTS

| | | | | |
|---|---|---|---|---|
| 2007/0206082 | A1* | 9/2007 | Mushimoto | B41J 2/32 347/101 |
| 2010/0245522 | A1 | 9/2010 | Miyashita et al. | |
| 2012/0327167 | A1 | 12/2012 | Tsuchiya et al. | |
| 2016/0059588 | A1 | 3/2016 | Aizawa | |

FOREIGN PATENT DOCUMENTS

| | | | |
|---|---|---|---|
| EP | 1 338 423 | A2 | 8/2003 |
| EP | 1 719 628 | A1 | 11/2006 |
| EP | 2 537 680 | A1 | 12/2012 |
| JP | 2013-6288 | A | 1/2013 |
| WO | WO 205/090086 | A1 | 9/2005 |

OTHER PUBLICATIONS

Extended Search Report in corresponding European Application No. 17171329.0, dated Oct. 18, 2017, 8 pages.

* cited by examiner

*Primary Examiner* — Justin Seo
(74) *Attorney, Agent, or Firm* — Brinks Gilson & Lione

(57) ABSTRACT

A thermal printer includes a frame having a first side plate portion and a second side plate portion, and a base portion which crosses over between the first side plate portion and the second side plate portion, a thermal head supported on the frame, a platen roller supported on respective shaft support portions of the first side plate portion and the second side plate portion, a drive source supported in a cantilevered state on a drive support portion of the first side plate portion, and is connected to the platen roller, an engaged portion arranged in the base portion, and an engagement portion which is connected to the drive source and is engageable with the engaged portion, and is configured to regulate displacement of the drive source with respect to the base portion.

11 Claims, 7 Drawing Sheets

THERMAL PRINTER AND PORTABLE TERMINAL

RELATED APPLICATIONS

This application claims priority under 35 U.S.C. § 119 to Japanese Patent Application No. 2016-098105 filed on May 16, 2016, the entire content of which is hereby incorporated by reference.

BACKGROUND OF THE INVENTION

Technical Field

1. Field of the Invention

The present invention relates to a thermal printer and a portable terminal.

2. Description of the Related Art

Hitherto, a thermal printer has been known as a printer configured to perform printing on a recording sheet (heat-sensitive paper). The thermal printer includes a thermal head, a platen roller, and a frame. The thermal head includes a heating element. The platen roller is configured to feed the recording paper by nipping the recording paper with the thermal head. The frame is configured to support the platen roller and the thermal head. In the thermal printer, the heating element of the thermal head is caused to generate heat as appropriate during a course of feeding the recording paper through rotation of the platen roller, thereby being capable of printing various information on the recording paper.

The above-mentioned frame includes a first side plate portion, a second side plate, and a base portion. The first side plate portion and the second side plate portion are arranged opposed to each other in an axial direction of the platen roller. The base portion crosses over between the side plate portions. On respective portions of the side plate portions protruding in one direction with respect to the base portion, the platen roller is supported so as to be rotatable. On a portion of the first side plate portion protruding in another direction (hereinafter referred to as "motor support portion") with respect to the base portion, a motor is supported in a cantilevered state. In the thermal printer, the platen roller is rotated by transmission of power of the motor through intermediation of gears or the like.

However, with regard to the related-art thermal printer, there is still room for improvement in prevention of damage on the frame due to a drop impact or the like. Specifically, when the motor is displaced in a direction away from the base portion due to the drop impact or the like, the motor support portion is flexurally deformed at a connection portion to the base portion as an originating point. In this case, in the related-art thermal printer, the motor is supported on the motor support portion in the cantilevered state, with the result that a large moment acts on the connection portion between the motor support portion and the base portion due to inertia of the motor. As a result, there is a fear of causing plastic deformation, fracture, or the like in the frame. Therefore, it has been demanded for the thermal printer of this type to be able to prevent damage on the frame due to the drop impact or the like.

SUMMARY OF THE INVENTION

According to one embodiment of the present invention, there is provided a thermal printer, including a frame having a first side plate portion and a second side plate portion which are opposed to each other in a first direction and extend in a second direction intersecting the first direction, and a base portion which extends in the first direction and crosses over between the first side plate portion and the second side plate portion, a thermal head supported on the frame, a platen roller which is supported on respective shaft support portions of the first side plate portion and the second side plate portion, which are located on one side in the second direction with respect to the base portion, so as to be rotatable about an axis extending in the first direction, and is opposed to the thermal head, a drive source which is supported in a cantilevered state in the first direction on a drive support portion located on another side of the first side plate portion in the second direction with respect to the base portion, and is connected to the platen roller, an engaged portion arranged in the base portion, and an engagement portion which is connected to the drive source and is engageable with the engaged portion, and is configured to regulate displacement of the drive source toward another side in the second direction with respect to the base portion.

In the above-mentioned thermal printer according to the one embodiment of the present invention, wherein a speed reduction mechanism configured to reduce power of the drive source is arranged between the drive source and the drive support portion in the first direction.

In the above-mentioned thermal printer according to the one embodiment of the present invention, wherein the drive source includes a flange portion supported on the first side plate portion, and wherein the engagement portion is integrally formed with the flange portion.

In the above-mentioned thermal printer according to the one embodiment of the present invention, wherein the drive source includes a flange portion supported on the first side plate portion, and wherein the engagement portion is arranged closer to the second side plate portion in the first direction with respect to the flange portion.

The above-mentioned thermal printer according to the one embodiment of the present invention, further comprising a fastening member which penetrates through the first side plate portion and the flange portion in the first direction and is configured to fasten the first side plate portion and the drive source to each other, wherein the engagement portion is a portion of the fastening member which protrudes closer to the second side plate portion in the first direction with respect to the flange portion.

In the above-mentioned thermal printer according to the one embodiment of the present invention, wherein a holding member configured to hold the drive source is provided at an end portion of the drive source which is closer to the second side plate portion in the first direction, and wherein the engagement portion is formed on the holding member.

According to one embodiment of the present invention, there is provided a portable terminal, including: the above-mentioned thermal printer, and a casing to which the thermal printer is mounted.

DETAILED DESCRIPTION OF THE PREFERRED EMBODIMENTS

Figure 1:
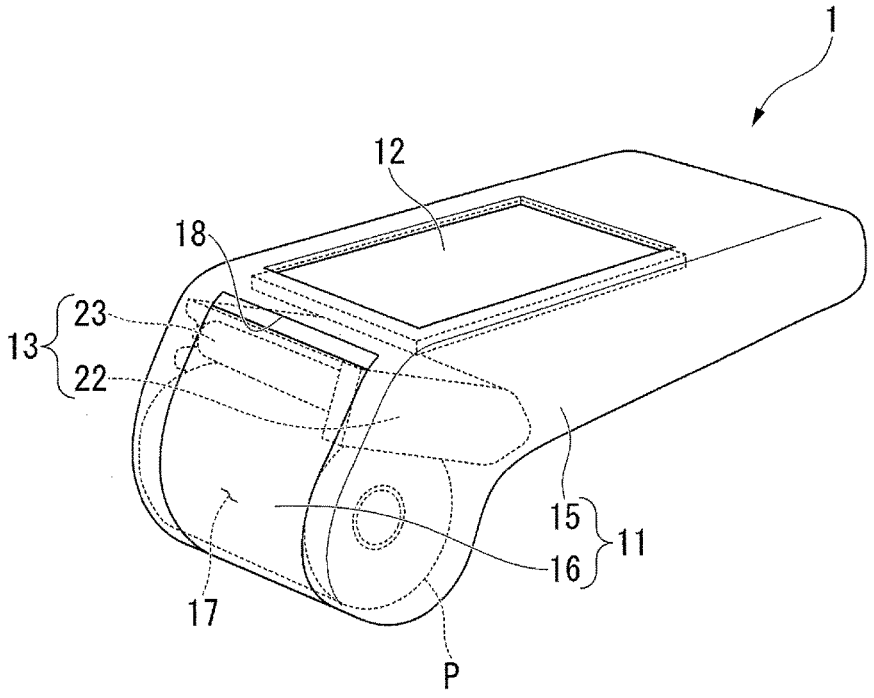
FIG. 1 is a perspective view of a portable terminal according to one embodiment of the present invention.

Now, embodiments of the present invention are described with reference to the accompanying drawings. FIG. 1 is a perspective view of a portable terminal 1. As illustrated in FIG. 1, the portable terminal 1 is, for example, a payment terminal which is portable by a user. The portable terminal 1 includes a casing 11, an input display portion 12, and a thermal printer 13.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (heat-sensitive paper). The recording paper P is received, under a state of being wound into a roll, in the recording paper receiving portion 17. The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to discharge the recording paper P to the outside, between an opening edge of the recording paper receiving portion 17 and a distal edge of the printer cover 16. The input display portion 12 is arranged on a front surface of the casing 11. The input display portion 12 is, for example, a touch panel. The input display portion 12 is configured to display various information on a screen and enable operation to the information displayed on the screen.

The thermal printer 13 is mounted at a position adjacent to the discharge port 18 in the casing 11. The thermal printer 13 is configured to print information with respect to the recording paper P, which is fed from the recording paper receiving portion 17, and to discharge the recording paper P through the discharge port 18.

Figure 2:
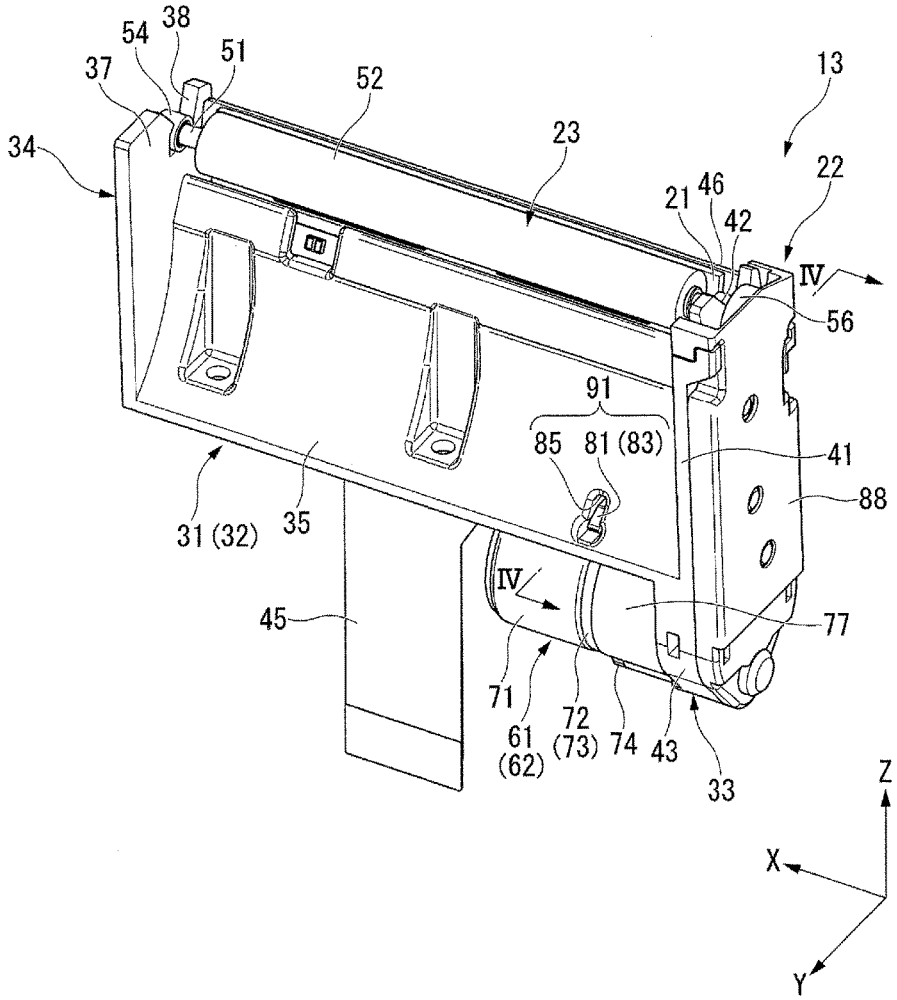
FIG. 2 is a perspective view for illustrating a thermal printer according to a first embodiment of the present invention.
Figure 3:
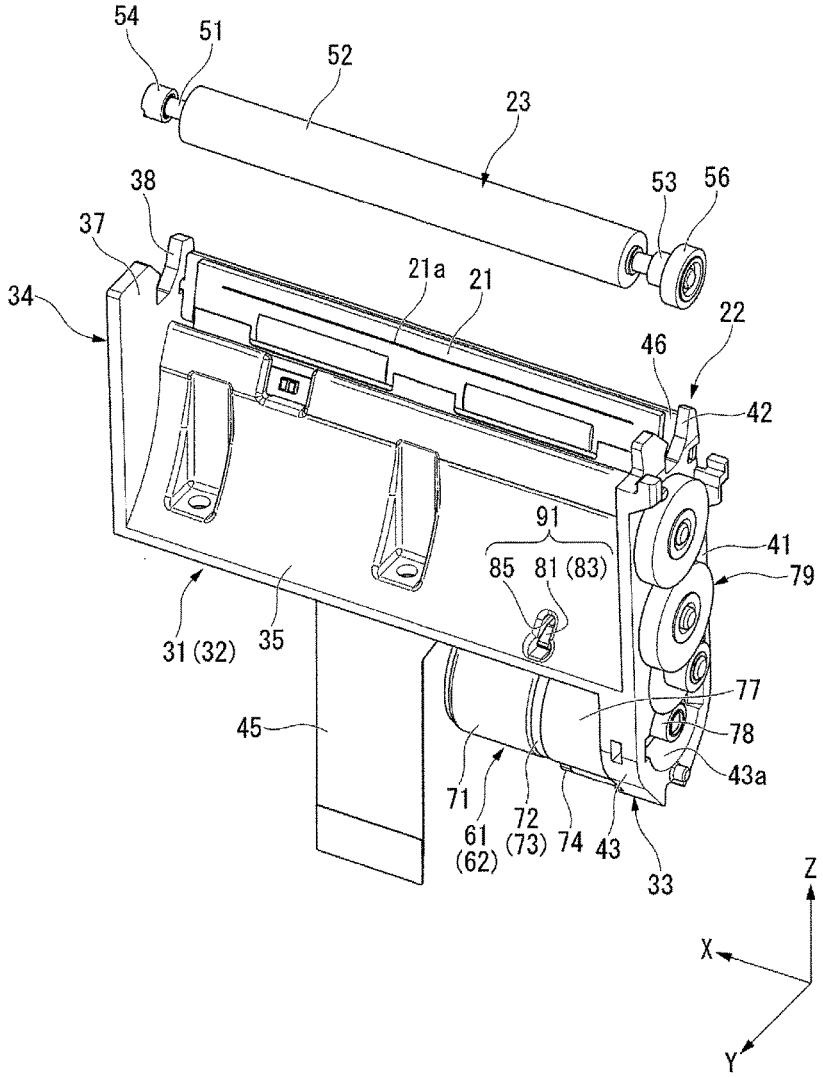
FIG. 3 is an exploded perspective view of the thermal printer according to the first embodiment.

FIG. 2 is a perspective view of the thermal printer 13. FIG. 3 is an exploded perspective view of the thermal printer 13. As illustrated in FIG. 2 and FIG. 3, the thermal printer 13 includes a head unit 22 and a platen roller 23. The head unit 22 includes a thermal head 21. In the example illustrated in FIG. 1, the head unit 22 is assembled to the casing main body 15. The platen roller 23 is assembled to the printer cover 16 and is rotatably supported on the printer cover 16. The printer cover 16 has a shaft in the lower part of FIG. 1, and is opened by left-front side of FIG. 1. At that time, the platen roller 23 moves with the printer cover 16. Thereby, the platen roller 23 and the thermal head 21 (the part of head unit 22) are removed, and the recording paper becomes in a free state. Conversely, when the printer cover 16 is closed, the platen roller 23 follows with the printer cover 16. At that time, the platen roller 23 is located at the position contact with the thermal head 21. In this way, the head unit 22 and the platen roller 23 are combined so as to be separable along with opening and closing of the printer cover 16. When the printer cover 16 takes a closed position, the head unit 22 and the platen roller 23 are opposed to each other across the above-mentioned discharge port 18. In the following description, an axial direction of the platen roller 23 is described as an X direction (first direction), and two directions orthogonal to the X direction are described as a Y direction and a Z direction (second directions). Further, in the following description, in each of the X direction, the Y direction, and the Z direction, a direction indicated by the arrow in the drawings is described as a plus direction, and a direction opposite to the arrow is described as a minus direction.

As illustrated in FIG. 3, a frame 31 of the head unit 22 is formed into a U-shape which is opened in a plus Z direction in front view from the Y direction. Specifically, the frame 31 includes a base portion 32, a first side plate portion 33, and a second side plate portion 34. The base portion 32 extends in the X direction. The first side plate portion 33 and the second side plate portion 34 are connected to both end portions of the base portion 32 in the X direction. The base portion 32 includes a guide wall 35 and a back surface plate 36 (see FIG. 4). The guide wall 35 is located in a plus Y direction of the base portion 32. The back surface plate 36 is located in a minus Y direction with respect to the guide wall 35. A surface of the guide wall 35 which is oriented in the plus Y direction constructs a paper passage surface which is configured to guide the recording paper P in the plus Z direction. The paper passage surface is a curved surface which protrudes in the minus Y direction.

Figure 4:
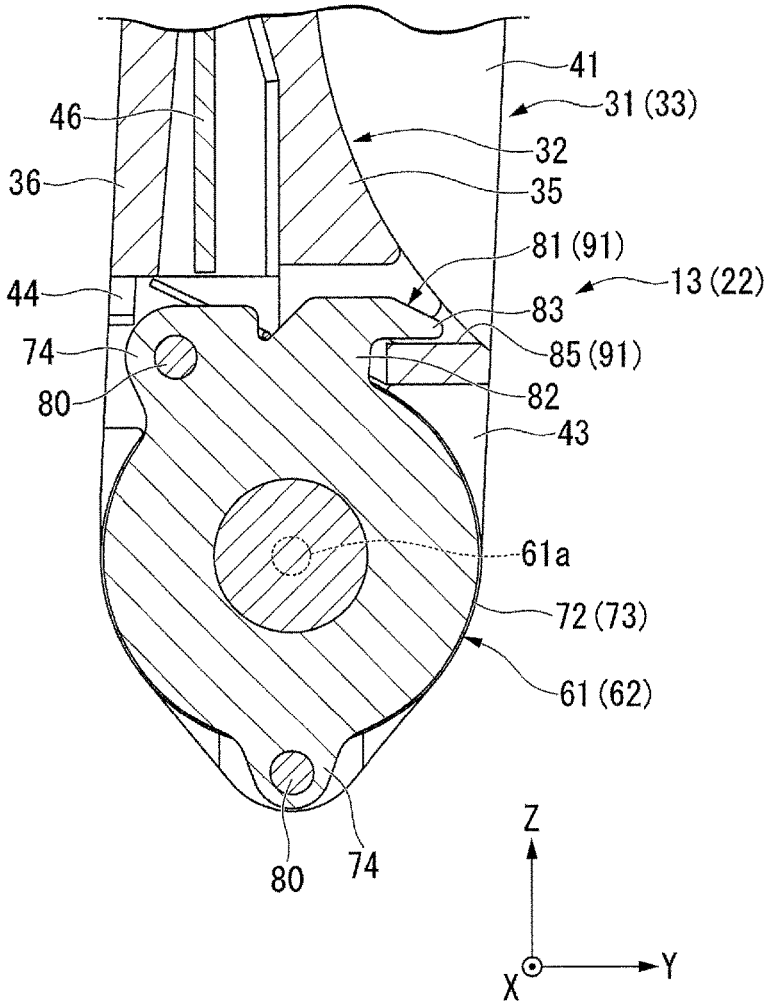
FIG. 4 is a sectional view taken along the line IV-IV of FIG. 2.

FIG. 4 is a sectional view taken along the line IV-IV of FIG. 2. As illustrated in FIG. 4, the back surface plate 36 is arranged so that a center portion thereof in the X direction is opposed to the guide wall 35 at an interval in the Y direction. Meanwhile, both end portions of the back surface plate 36 in the X direction are connected to the guide wall 35. An end edge of the back surface plate 36 in the plus Z direction is located in a minus Z direction with respect to an end edge of the guide wall 35 in the plus Z direction. An end edge of the back surface plate 36 in the minus Z direction is located in the plus Z direction with respect to an end edge of the guide wall 35 in the minus Z direction.

As illustrated in FIG. 3, first, the second side plate portion 34 is connected to an end portion of the base portion 32, which includes the guide wall 35 and the back surface plate 36, in a plus X direction. A portion of the second side plate portion 34 which protrudes in the plus Z direction with respect to the base portion 32 constructs a second shaft support portion 37. At an end edge of the second shaft support portion 37 in the plus Z direction, there is formed a second roller receiving groove 38 which is recessed in the minus Z direction.

The first side plate portion 33 is connected to the end portion of the base portion 32 in a minus X direction. A portion of the first side plate portion 33 which protrudes in the plus Z direction with respect to the base portion 32 constructs a first shaft support portion 41. At an end edge of the first shaft support portion 41 in the plus Z direction, there is formed a first roller receiving groove 42 which is recessed in the minus Z direction. A portion of the first side plate portion 33 which protrudes in the minus Z direction with respect to the base portion 32 constructs a motor support portion (drive support portion) 43.

Figure 5:
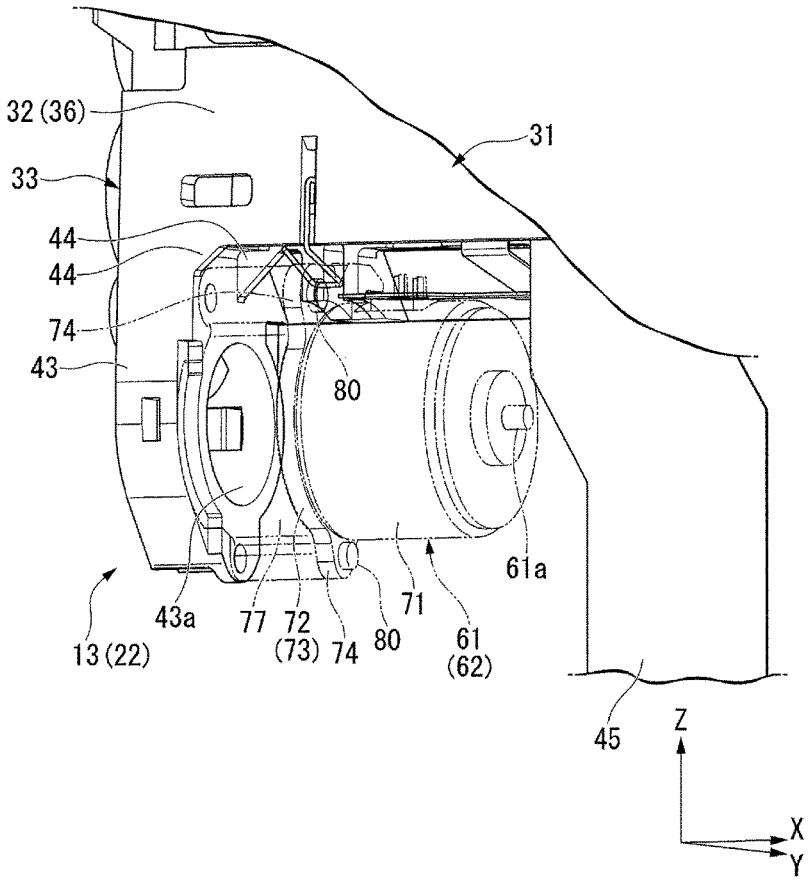
FIG. 5 is a perspective view of the thermal printer according to the first embodiment as viewed from a minus Z direction.

FIG. 5 is a perspective view of the thermal printer 13 as viewed from the minus Z direction. As illustrated in FIG. 5, at a connection portion between the motor support portion 43 and the base portion 32, that is, at a corner portion formed by an end surface of the motor support portion 43 in the plus X direction and an end surface of the base portion 32 in the minus Z direction, there are formed ribs 44 which protrude in the minus Z direction. A plurality of ribs 44 are formed at the connection portion between the motor support portion 43 and the base portion 32 at intervals in the minus Y direction. Each rib 44 has a triangular shape in front view as viewed from the Y direction. The ribs 44 are formed in a range of from an end portion of the motor support portion 43 in the plus Z direction to the end portion of the base portion 32 in the minus X direction. The shape and number of the ribs 44 can be changed as appropriate.

As illustrated in FIG. 3, the thermal head 21 has a plate-like shape having a thickness direction in the Y direction and extending in the X direction. On an end surface of the thermal head 21 which is oriented in the plus Y direction, a plurality of heating elements 21*a* are arrayed at intervals in the X direction. The thermal head 21 is connected to a controller (not shown) or the like through a flexible board 45. A driver IC (not shown) mounted to the thermal head 21 controls heat generation of the heating element 21*a* in accordance with a signal from the controller, with the result that the thermal head 21 performs printing with respect to the recording paper P.

The thermal head 21 is fixed to a head support plate 46. The head support plate 46 is rotatably supported at portions of the frame 31 which are located in the minus Y direction with respect to the roller receiving grooves 38 and 42. The head support plate 46 has a plate-like shape having a thickness direction in the Y direction and extending in the X direction. The thermal head 21 is bonded to an end surface of the head support plate 46 in the plus Y direction. An urging member (not shown) is interposed between the head support plate 46 and the frame 31. The urging member is configured to urge the head support plate 46 in the plus Y direction. With this, the thermal head 21 is pressed against the platen roller 23.

The platen roller 23 nips the recording paper P with the thermal head 21 to convey the recording paper P toward the discharge port 18. Specifically, the platen roller 23 includes a platen shaft 51 and a roller main body 52. The platen shaft 51 extends in the X direction. At both end portions of the platen shaft 51 in the X direction, there are mounted a first bearing 53 and a second bearing 54, respectively. The bearings 53 and 54 are retained in the above-mentioned roller receiving grooves 38 and 42, respectively. With this, the platen roller 23 is supported on the shaft support portions 37 and 41 (frame 31) so as to be rotatable about an axis extending in the X direction and so as to be removable from the frame 31. At a portion of the platen shaft 51 which is located in the minus X direction with respect to the first platen shaft 53, there is arranged a driven gear 56. Under a state in which the platen roller 23 is retained in the roller receiving grooves 38 and 42, the driven gear 56 is positioned in the minus X direction from the first shaft support portion 41.

The roller main body 52 is made of, for example, rubber. The roller main body 52 is externally mounted to a portion of the platen shaft 51 other than the both end portions of the platen shaft 51 in the X direction. An outer peripheral surface of the roller main body 52 is held in contact with the above-mentioned thermal head 21.

As illustrated in FIG. 5, a motor (drive source) 61 is arranged at a portion of the above-mentioned frame 31 which is located in the plus X direction with respect to the motor support portion 43. The motor 61 is arranged so that a rotor and a stator (not shown) which are arranged coaxially with a rotary shaft 61*a* extending in the X direction are received in a motor case 62. The motor 61 is connected to the controller through intermediation of the flexible board 45.

The above-mentioned motor case 62 includes a case main body 71 and a motor flange (flange portion) 72. The case main body 71 is formed into a bottomed cylindrical shape which is opened in the minus X direction. The motor flange 72 is fixed to an end edge of the case main body 71 in the minus X direction by welding or the like. As illustrated in FIG. 4, the motor flange 72 includes a ring plate 73 which closes an opening portion of the case main body 71. The rotary shaft 61*a* passes an inner side of the ring plate 73 in the X direction. At some portions of the ring plate 73 in a peripheral direction of the rotary shaft 61*a*, there are formed a plurality of mounting pieces 74, which protrude in a radial direction of the rotary shaft 61*a*, at intervals in the peripheral direction. The case main body 71 and the motor flange 72 may be made of the same material and formed integrally with each other.

As illustrated in FIG. 3, between the motor 61 and the motor support portion 43 in the X direction, there is arranged a first speed reduction mechanism (speed reduction mechanism) 77 configured to reduce power of the motor 61. The first speed reduction mechanism 77 is, for example, a planetary gear mechanism. The motor 61 and the first speed reduction mechanism 77 are fastened together to the motor support portion 43 by screws (fastening member) 80 illustrated in FIG. 4. Specifically, the screws 80 penetrate through the motor support portion 43 and the first speed reduction mechanism 77 and are screwed to the mounting pieces 74 of the motor 61. With this, the motor 61 and the first speed reduction mechanism 77 of a first embodiment of the present invention are supported on the motor support portion 43 in a cantilevered state. In the illustrated example, two screws 80 are used to fix the motor 61 and the first speed reduction mechanism 77. However, the number and layout of the screws 80 can be changed as appropriate. Further, the motor 61 may be fixed to the motor support portion 43 by a method other than the use of the screws 80.

As illustrated in FIG. 3, the first speed reduction mechanism 77 has an output gear 78 which protrudes in the minus X direction. The output gear 78 protrudes through a through hole 43*a*, which is formed in the motor support portion 43, in the minus X direction with respect to the motor support portion 43.

At a portion which is located in the minus X direction with respect to the above-mentioned first side plate portion 33, there is arranged a second speed reduction mechanism 79. The second speed reduction mechanism 79 is a gear train mechanism including a two-step gear. The second speed reduction mechanism 79 provides connection between the output gear 78 of the first speed reduction mechanism 77 and a driven gear 56 of the platen roller 23. As illustrated in FIG. 2, the second speed reduction mechanism 79 is covered with a gear cover 88 from the minus X direction.

As illustrated in FIG. 4, at a portion of an outer peripheral edge of the above-mentioned ring plate 73 which is located in the plus Z direction, there is formed an engagement portion 81. The engagement portion 81 is formed into an L-shape in side view as viewed from the X direction. Specifically, the engagement portion 81 includes a leg portion 82 and a protruding portion 83. The leg portion 82 protrudes from the ring plate 73 in the plus Z direction. The protruding portion 83 is connected to an end portion of the leg portion 82 in the plus Z direction. The protruding portion 83 extends in the plus Y direction from the leg portion 82.

That is, the protruding portion 83 extends toward one side in a tangential direction of an imaginary circle having a center at the rotary shaft 61*a* in side view as viewed from the X direction. An end edge of the protruding portion 83 in the plus Z direction is inclined in the minus Z direction as proceeding in the plus Y direction. Meanwhile, an end edge of the protruding portion 83 in the minus Z direction linearly extends in the plus Y direction.

At a portion of the guide wall 35 of the above-mentioned base portion 32 which is opposed to the protruding portion 83 in the Y direction, there is formed an engaged portion 85 which receives the protruding portion 83. The engaged portion 85 penetrates through the guide wall 35 in the Y direction (see FIG. 2 and FIG. 3). As long as the engaged portion 85 is opened at least in the minus Y direction, that is, on another side in the tangential direction of the imaginary circle having a center at the rotary shaft 61*a*, the engaged portion 85 need not penetrate through the guide wall 35.

In the engaged portion 85, the end edge of the above-mentioned protruding portion 83 in the minus Z direction is opposed to an inner surface of the engaged portion 85 in the Z direction. With this, the protruding portion 83 is engageable with the inner surface of the engaged portion 85 from the plus Z direction. In the first embodiment, the engagement portion 81 and the engaged portion 85 construct a regulation portion 91 configured to regulate displacement of the motor 61 in the minus Z direction with respect to the frame 31. The end edge of the protruding portion 83 in the minus Z direction may be held in abutment against the inner surface of the engaged portion 85 in advance.

Next, an operation method of the above-mentioned portable terminal 1 is described. In the following description, it is assumed that a leading edge of the recording paper P is nipped between the platen roller 23 and the thermal head 21. In the portable terminal 1, printing with respect to the recording paper P is started through operation to the input display portion 12. Specifically, a signal is output from the controller to the motor 61 through, for example, the flexible board 45, with the result that the motor 61 rotates. The power of the motor 61 is reduced by the first speed reduction mechanism 77 and the second speed reduction mechanism 79 and thereafter is transmitted to the driven gear 56. With this, the platen roller 23 is rotated. Then, the recording paper P nipped between the outer peripheral surface of the platen roller 23 and the thermal head 21 is delivered toward the discharge port 18.

When the signal is output from the controller to the thermal head 21 through the flexible board 45 during the course of delivering the recording paper P through rotation of the platen roller 23, the heating elements 21*a* of the thermal head 21 generate heat as appropriate. With this, various information is printed with respect to the recording paper P. Then, the recording paper P discharged through the discharge port 18 is cut and used as, for example, a receipt.

Next, an action of the thermal printer 13 according to the first embodiment is described. In the following, description is made of the action of the thermal printer 13 with respect to a drop impact which is imparted to the thermal printer 13 when the portable terminal 1 is dropped with its lower side corresponding to the minus Z direction of the thermal printer 13. When a drop load or the like acts on the thermal printer 13 from the minus Z direction, there is a case where the motor 61, which includes the first speed reduction mechanism 77, is displaced in the minus Z direction with respect to the base portion 32 by inertia. There is a fear in that, when the motor 61 is displaced in the minus Z direction, the motor support portion 43 is flexurally deformed in the minus X direction at the connection portion to the base portion 32 as an originating point.

Thus, in the first embodiment, when the motor 61 is displaced in the minus Z direction, the protruding portion 83 of the motor 61 is brought into engagement with or abutment against the inner surface of the engaged portion 85 from the plus Z direction. With this, the displacement of the motor 61 in the minus Z direction with respect to the base portion 32 is regulated, thereby preventing the flexural deformation of the motor support portion 43.

As described above, in the first embodiment, there is provided the engagement portion 81 which is engageable with the engaged portion 85 and is configured to regulate the displacement of the motor 61 in the minus Z direction with respect to the base portion 32. With this configuration, the displacement of the motor 61 in the minus Z direction with respect to the base portion 32 is regulated through engagement of the engagement portion 81 and the engaged portion 85, thereby being capable of preventing the flexural deformation of the motor support portion 43. Therefore, damage on the frame 31 due to the drop load which acts on the thermal printer 13 can be prevented. As a result, the thermal printer 13 which is excellent in durability and reliability can be provided.

In the first embodiment, as described above, the first speed reduction mechanism 77 is arranged between the motor support portion 43 and the motor 61. In this case, a distance between the motor support portion 43 and the motor 61 becomes longer as compared to the case where the motor 61 is directly fixed to the motor support portion 43. Thus, there is a fear in that, when the drop load or the like acts on the thermal printer 13, a large moment acts on the connection portion between the motor support portion 43 and the base portion 32. However, in the first embodiment, displacement of the motor 61 with respect to the base portion 32 is regulated by the regulation portion 91. Thus, even when the first speed reduction mechanism 77 is arranged between the motor support portion 43 and the motor 61, damage on the frame 31 can reliably be prevented. In this case, the first speed reduction mechanism 77 can be arranged on an inner side, that is, in the plus X direction with respect to the motor support portion 43, thereby being capable of reducing the dimension of the first side plate portion 33 of the frame 31 in the minus X direction. As a result, the thermal printer 13 can be downsized in the X direction.

In the first embodiment, the engagement portion 81 formed integrally with the motor flange 72 is received in the engaged portion 85 formed in the base portion 32, thereby being capable of preventing increase in number of parts due to addition of the regulation portion 91.

In the first embodiment, the engagement portion 81 (protruding portion 83) protrudes toward one side in a tangential direction of the imaginary circle having a center at the rotary shaft 61*a*, that is, in the plus Y direction, and the engaged portion 85 is opened toward another side in the tangential direction, that is, in the minus Y direction. With this configuration, the motor 61 is rotated about the rotary shaft 61*a* to be assembled to the frame 31, thereby being capable of allowing the protruding portion 83 to enter the engaged portion 85. With this, degradation in assemblability due to the formation of the engagement portion 81 can be prevented.

Further, the portable terminal 1 according to the first embodiment includes the above-mentioned thermal printer 13. Therefore, the portable terminal 1 which is excellent in durability and reliability can be provided.

In the above-mentioned embodiment, description is made of the configuration in which the engagement portion 81 and the engaged portion 85 extend in the Y direction. However, as long as the displacement of the motor 61 in the minus Z direction with respect to the base portion 32 is regulated, the engagement portion 81 and the engaged portion 85 may extend in, for example, the X direction. In the above-mentioned embodiment, description is made of the configuration in which the engagement portion 81 is integrally formed with the motor flange 72. However, not limited to this configuration, the engagement portion 81 may be formed separately from the motor flange 72. Similarly, the engaged portion 85 may be formed integrally with the base portion 32 or separately from the base portion 32.

Figure 6:
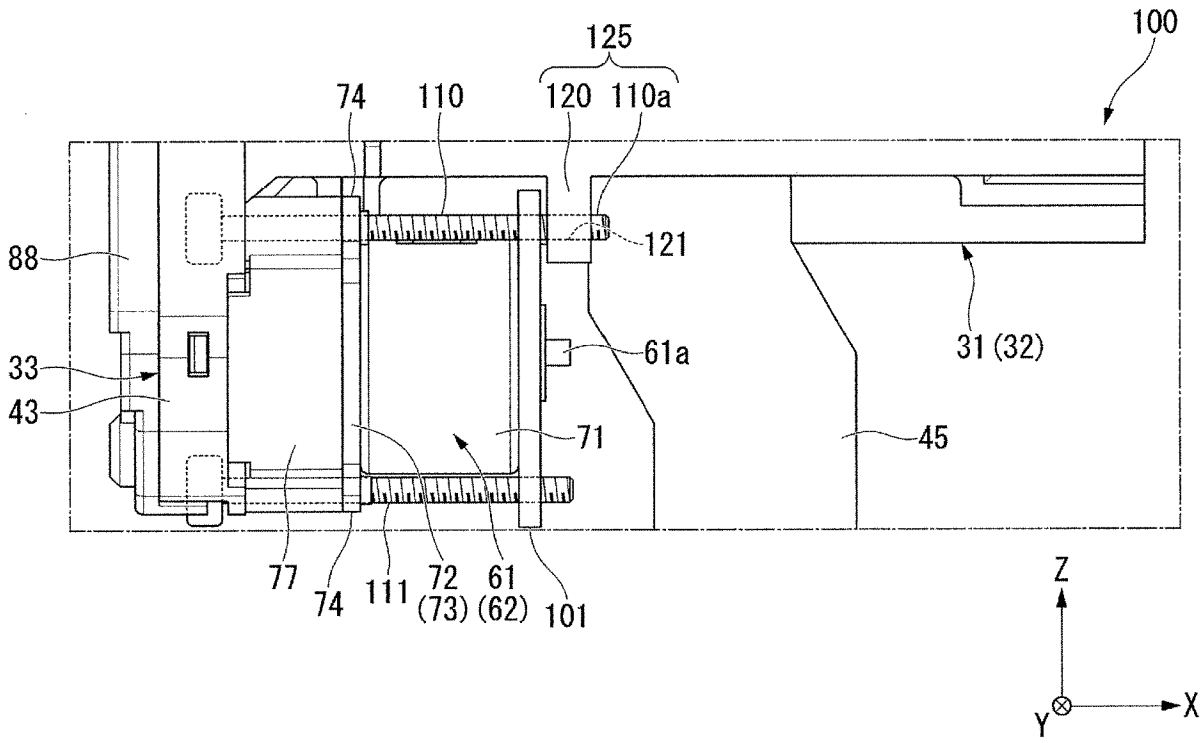
FIG. 6 is an enlarged back view of a thermal printer according to a second embodiment of the present invention as viewed from a minus Y direction.

A second embodiment of the present invention is described. FIG. 6 is an enlarged back view of a thermal printer 100 according to the second embodiment as viewed from the minus Y direction. The thermal printer 100 according to the second embodiment is different from the above-mentioned embodiment in that the displacement of the motor 61 with respect to the base portion 32 is regulated through use of a screw 110. In the following description, components which are the same as those of the above-mentioned embodiment are denoted by the same reference symbols, and description thereof is omitted. In the thermal printer 100 illustrated in FIG. 6, an end plate 101 is provided at an end portion of the case main body 71 in the plus X direction. The end plate 101 is opposed to the motor flange 72 in the X direction with the case main body 71 sandwiched therebetween. The end plate 101 has an outer shape which is larger than that of the case main body 71 in side view as viewed from the X direction. The end plate 101 may be provided integrally with the case main body 71 or separately from the case main body 71.

In the second embodiment, screws 110 and 111 penetrate through the motor support portion 43, the first speed reduction mechanism 77, and the mounting pieces 74 of the motor 61, and are screwed to the end plate 101. With this, the motor 61 and the first speed reduction mechanism 77 are supported on the motor support portion 43 in a cantilevered state. In the illustrated example, the screws 110 and 111 penetrate through the end plate 101 in the X direction. One of the screws 110 and 111 which is located in the plus Z direction (hereinafter referred to as "first screw 110") has a portion which protrudes in the plus X direction with respect to the end plate 101. This portion constructs an engagement portion 110*a*.

A portion of the base portion 32 which is located in the plus X direction from the end plate 101 has an engagement piece (engaged portion) 120 which protrudes in the minus Z direction. At a portion of the engagement piece 120 which overlaps with the above-mentioned first screw 110 in side view as viewed from the X direction, there is formed an insertion hole 121 into which the first screw 110 is inserted. In the insertion hole 121, the engagement portion 110*a* of the first screw 110 is opposed to an inner surface of the insertion hole 121 in the Z-direction. With this, the first screw 110 is engageable with the inner surface of the insertion hole 121 from the plus Z direction. In the second embodiment, the first screw 110 and the engagement piece 120 construct a regulation portion 125 configured to regulate the displacement of the motor 61 in the minus Z direction with respect to the base portion 32. In the second embodiment, description is made of the configuration in which the engagement portion 110*a* of the first screw 110 is engaged in the insertion hole 121. However, not limited to this configuration, it is only necessary that the first screw 110 and the engagement piece 120 be engageable with each other.

Also in the second embodiment, the regulation portion 125 regulates the displacement of the motor 61 in the minus Z direction with respect to the base portion 32, thereby being capable of preventing the flexural deformation of the motor support portion 43.

Particularly, in the second embodiment, the regulation portion 125 is provided in the plus X direction with respect to the motor 61. With this configuration, the regulation portion 125 is arranged at a position apart from the motor support portion 43, that is, at a position where large displacement occurs when the drop load or the like acts on the thermal printer 100, thereby being capable of effectively preventing the displacement of the motor 61 with respect to the base portion 32.

In the second embodiment, the portion of the first screw 110 which protrudes from the end plate 101 constructs the engagement portion 110*a*, thereby being capable of preventing the increase in number of parts due to addition of the engagement portion 110*a*.

In the above-mentioned embodiment, description is made of the configuration in which the first screw 110 is screwed to the end plate 101. However, not limited to this, the end plate 101 may be omitted. In this case, it is only necessary that the first screw 110 be screwed to the motor flange 72 (mounting pieces 74) as in the first embodiment, and that the portion of the first screw 110 protruding in the plus X direction from the motor flange 72 be engageable with the engagement piece 120. In the above-mentioned embodiment, description is made of the configuration in which the regulation portion 125 is arranged in the plus X direction with respect to the motor 61. However, not limited to this configuration, it is only necessary that the regulation portion 125 be arranged in the plus X direction from the motor flange 72. In the above-mentioned embodiment, description is made of the configuration in which the first screw 110, which is located in the plus Z direction, of the screws 110 and 111 is brought into engagement with the engagement piece 120. However, the configuration is not limited thereto. That is, it is only necessary that at least one of the screws 110 and 111 be engageable with the engagement piece 120.

Figure 7:
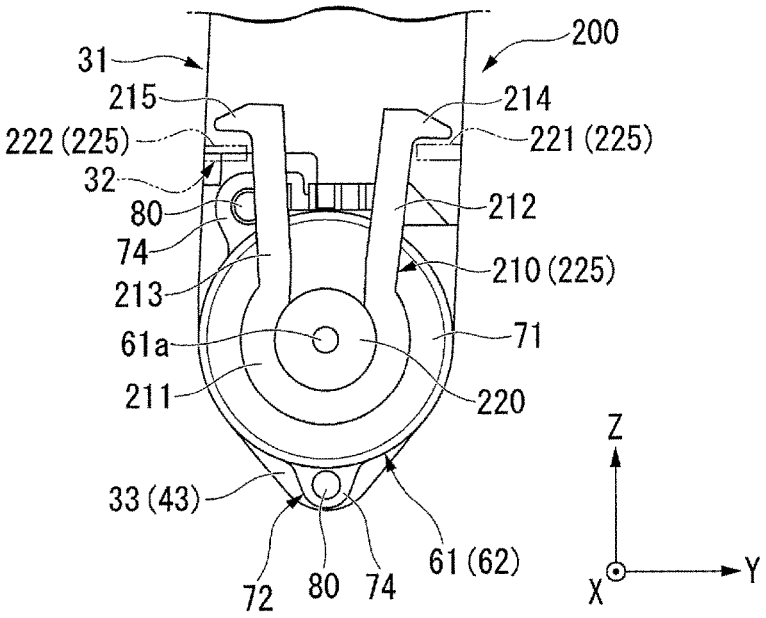
FIG. 7 is an enlarged side view of a thermal printer according to a third embodiment of the present invention as viewed from a plus X direction.

Next, a third embodiment of the present invention is described. FIG. 7 is an enlarged side view of a thermal printer 200 according to the third embodiment as viewed from the plus X direction. The thermal printer 200 according to the third embodiment is different from the above-mentioned embodiments in that a holding member 210 configured to hold the motor 61 has engagement portions 214 and 215. In the following description, components which are the same as those of the above-mentioned embodiments are denoted by the same reference symbols, and description thereof is omitted. In the thermal printer 200 illustrated in FIG. 7, the holding member 210 connects an end portion of the motor 61 in the plus X direction and the base portion 32 to each other. The holding member 210 is formed into a U-shape which is opened in the plus Z direction in side view as viewed from the X direction. Specifically, the holding member 210 includes a holding portion 211 and a pair of arm portions 212 and 213 connected to the holding portion 211. The holding member 210 is integrally made of an elastically deformable material.

The holding portion 211 is formed into an arc shape in side view as viewed from the minus X direction. The holding portion 211 surrounds an end portion of the motor 61 (case main body 71) in the plus X direction from the minus Z direction. With this, the holding portion 211 removably holds the motor 61. In the illustrated example, the holding portion 211 holds a boss portion 220 of the case main body 71 which protrudes in the plus X direction.

The arm portions 212 and 213 extend in the plus Z direction from both end portions of the holding portion 211, respectively. At end portions of the arm portions 212 and 213 in the plus Z direction, there are provided engagement portions 214 and 215. The engagement portions 214 and 215 protrude at the arm portions 212 and 213 in directions away from each other in the Y direction, respectively. The engagement portions 214 and 215 are engageable with engaged portions 221 and 222, which are formed in the base portion 32, from the plus Z direction, respectively. In the third embodiment, the holding member 210 and the engaged portions 221 and 222 construct a regulation portion 225 configured to regulate the displacement of the motor 61 in the minus Z direction with respect to the base portion 32.

According to the third embodiment, the regulation portion 225 is arranged at a position apart from the motor support portion 43, that is, at a position where large displacement occurs when the drop load or the like acts on the thermal printer 200, thereby being capable of effectively preventing the displacement of the motor 61 with respect to the base portion 32. In particular, in the third embodiment, the motor 61 is engaged with the base portion 32 through intermediation of the holding member 210 which is separated from the motor 61, thereby being capable of improving a degree of freedom in design of the holding member 210.

Note that, the technical scope of the present invention is not limited to the above-mentioned embodiments, but various modifications may be made without departing from the gist of the present invention.

In the above-mentioned embodiments, description is made of the case where the payment terminal is used as one example of the portable terminal 1. However, not limited to this configuration, the configuration of the present invention may be applied to various types of portable terminals.

Besides the above, the components in the above-mentioned embodiments may be replaced by well-known components as appropriate without departing from the gist of the present invention. The above-mentioned modified examples may be combined with each other as appropriate.

What is claimed is:

1. A thermal printer, comprising:

a frame including a width extending in a width direction and a length extending in a length direction, the frame comprising a first side plate, a second side plate and a base, the first and second side plates extending in the length direction and placed apart from and opposite to each other in the width direction, the base extending in the width direction between the first and second side plates, wherein the base comprises a first engagement member formed on the base;

a thermal head supported on the frame;

a platen roller rotatably supported between the first and second side plates in contact with the thermal head;

a drive source supported by the first side plate and operable to rotate the platen roller; and a second engagement member fixed to the drive source, wherein the second engagement member and the first engagement form a hook and a slot, respectively, which are engaged with each other by way of securing a distal end portion of the hook in the slot so as to regulate displacement of the drive source relative to the base portion.

2. The thermal printer according to claim 1, further comprising a speed reduction mechanism arranged between the drive source and the platen roller to transfer reduced speed from the drive source to the platen roller.

3. The thermal printer according to claim 2, further comprising a flange fixed to the drive source and supported on the first side plate, wherein the second engagement member is formed on the flange.

4. The thermal printer according to claim 3, wherein the second engagement member is arranged between the second side plate and the flange in the width direction.

5. The thermal printer according to claim 4, further comprising a fastening member which penetrates through the first side plate and the flange in the width direction and is configured to fasten together the first side plate and the drive source, wherein a portion of the fastening member forms the second engagement member between the second side plate and the flange in the width direction.

6. The thermal printer according to claim 2, further comprising a holding member having two arms each of which has the second engagement member at its distal end secured in the slot of the base, the holding member configured to hold the drive source between the two arms.

7. The thermal printer according to claim 1, further comprising a flange fixed to the drive source and supported on the first side plate, wherein the second engagement member is y formed on the flange.

8. The thermal printer according to claim 7, wherein the second engagement member is arranged between the second side plate and the flange in the width direction.

9. The thermal printer according to claim 8, further comprising a fastening member which penetrates through the first side plate and the flange in the width direction and is configured to fasten together the first side plate and the drive source, wherein a portion of the fastening member forms the second engagement member between the second side plate and the flange in the width direction.

10. A portable terminal, comprising:

the thermal printer of claim 1; and a casing to which the thermal printer is mounted.

11. A portable terminal, comprising:

the thermal printer of claim 6; and a casing to which the thermal printer is mounted.

* * * * *